US011324305B2

(12) United States Patent
Grenier et al.

(10) Patent No.: US 11,324,305 B2
(45) Date of Patent: May 10, 2022

(54) CARRYING ASSEMBLY

(71) Applicants: SAFRAN ELECTRONICS & DEFENSE, Paris (FR); SARL MKM, Seynod (FR)

(72) Inventors: Jordane Grenier, Moissy-Cramayel (FR); Marc Menetrier, Moissy-Cramayel (FR)

(73) Assignees: SAFRAN ELECTRONICS & DEFENSE, Paris (FR); SARL MKM, Seynod (FR)

( * ) Notice: Subject to any disclaimer, the term of this patent is extended or adjusted under 35 U.S.C. 154(b) by 0 days.

(21) Appl. No.: 17/438,259

(22) PCT Filed: Mar. 13, 2020

(86) PCT No.: PCT/EP2020/056840

§ 371 (c)(1),
(2) Date: Sep. 10, 2021

(87) PCT Pub. No.: WO2020/182982

PCT Pub. Date: Sep. 17, 2020

(65) Prior Publication Data

US 2022/0087402 A1 Mar. 24, 2022

(30) Foreign Application Priority Data

Mar. 13, 2019 (FR) ..... 19 02576

(51) Int. Cl.
*A45F 3/14* (2006.01)
*A45F 3/06* (2006.01)
(Continued)

(52) U.S. Cl.
CPC ..... *A45F 3/14* (2013.01); *A45F 3/06* (2013.01); *F41H 5/013* (2013.01); *F42B 39/02* (2013.01);
(Continued)

(58) Field of Classification Search
CPC .... A45F 3/14; A45F 3/06; F41H 5/013; F42B 39/02
(Continued)

(56) References Cited

U.S. PATENT DOCUMENTS 6,419,132 B1 * 7/2002 Reed ..... A45C 15/00 2/2.5
6,685,071 B2 * 2/2004 Prather ..... F41H 5/08 2/2.5
(Continued)

FOREIGN PATENT DOCUMENTS

WO WO-2012/081013 A1 6/2012
WO WO-2014/101245 A1 7/2014
WO WO-2017/192479 A1 11/2017

*Primary Examiner* — Nathan J Newhouse
*Assistant Examiner* — Lester L Vanterpool
(74) *Attorney, Agent, or Firm* — Muncy, Geissler, Olds & Lowe, P.C.

(57) ABSTRACT

A carrier assembly including a harness and a front bullet-proof chest plate; a first strap provided with a first element of a first quick connector; a second strap provided with a first element of a second quick connector; a third strap provided with a second element of the first quick connector; a fourth strap provided with a second element of the second quick connector; the front bullet-proof chest plate including third and fourth elements for cooperating respectively with the first and second elements of the first quick connector; and fifth and sixth elements for cooperating respectively with the first and second elements of the second quick connector.

16 Claims, 10 Drawing Sheets

(51) Int. Cl.
*F42B 39/02* (2006.01)
*F41H 5/013* (2006.01)
*A45F 3/00* (2006.01)

(52) U.S. Cl.
CPC ... *A45F 2003/003* (2013.01); *A45F 2003/146* (2013.01)

(58) Field of Classification Search
USPC ..... 224/576, 579
See application file for complete search history.

(56) References Cited

U.S. PATENT DOCUMENTS

| | | | | |
|---|---|---|---|---|
| 9,737,100 | B2 * | 8/2017 | McIntire, Jr. | A41D 15/04 |
| 9,820,558 | B1 * | 11/2017 | de Geus | A41D 1/04 |
| 10,130,160 | B1 * | 11/2018 | Cheng | A45F 4/02 |
| 10,231,533 | B2 * | 3/2019 | Vaughan | A45F 3/06 |
| 11,026,501 | B1 * | 6/2021 | Dabrowka | F41H 1/02 |
| 2007/0295772 | A1 * | 12/2007 | Woodmansee | F41H 1/02 224/153 |
| 2011/0231976 | A1 * | 9/2011 | Herbener | F41H 1/02 2/2.5 |
| 2012/0132066 | A1 * | 5/2012 | Seuk | F41H 1/02 89/937 |
| 2014/0101810 | A1 * | 4/2014 | Tirard | F41H 1/02 2/2.5 |
| 2016/0360864 | A1 * | 12/2016 | Drake | A45F 4/02 |
| 2017/0102214 | A1 * | 4/2017 | Wright | F41H 1/02 |
| 2017/0307335 | A1 * | 10/2017 | Skifstad | F41C 33/041 |
| 2018/0003466 | A1 * | 1/2018 | Rose | A45F 3/06 |

* cited by examiner

CARRYING ASSEMBLY

FIELD OF THE INVENTION

The invention relates to the field of carrying a load, and more particularly to a load being carried by a person on foot.

BACKGROUND OF THE INVENTION

Modern backpacks for outdoor activities usually include two vertical straps of adjustable length that are sewn to a back pouch for receiving the load that is to be moved. Usually a waist belt serves to transfer a portion of the weight of the backpack onto the user's hips and to limit the stresses applied to the user's upper body, essentially the shoulders and the trapezius muscles. It is difficult to make such a backpack compatible with wearing chest equipment such as a bullet-proof vest or an additional transport pouch. Specifically, such pieces of chest equipment interfere with the waist belt and with the vertical straps of the backpack. The chest equipment may also serve as a support for fastening other pieces of equipment (using one or more horizontal attachment strips in the form of sewn flat loops, known as the MOLLE system). When carrying both chest equipment and a prior art backpack in combination, localized pressure points arise, in particular at the devices for adjusting the lengths both of the vertical straps of the backpack and also of the waist belt. Rubbing between the chest equipment, the backpack, and the vertical straps gives rise to discomfort (abrasion) and increases the risk of the user becoming unbalanced as a result of making it easier for loads to move relative to the user's body.

OBJECT OF THE INVENTION

An object of the invention is to improve the comfort of a backpack when it is used in combination with wearing chest equipment.

SUMMARY OF THE INVENTION

To this end, there is provided a carrier assembly comprising a harness and a bullet-proof chest plate. The harness comprises:

- a back support;
- fastener means for fastening a payload to the harness;
- a first strap having a first end connected to the back support, and a second end provided with a first element of a first quick connector;
- a second strap having a first end connected to the back support, and a second end provided with a first element of a second quick connector;
- a third strap having a first end connected to the back support, and a second end provided with a second element of the first quick connector; and
- a fourth strap having a first end connected to the back support, and a second end provided with a second element of the second quick connector. The bullet-proof chest plate comprises a third quick connector element arranged to cooperate with the first element of the first quick connector, a fourth quick connector element arranged to cooperate with the second element of the first quick connector, a fifth quick connector element arranged to cooperate with the first element of the second quick connector, and a sixth quick connector element arranged to cooperate with the second element of the second quick connector.

Thus, the pressure points and the rubbing caused by superposing connection devices for carrying loads on the back and on the chest are eliminated, thereby contributing to improving user comfort. The weights of the payload and of the equipment usually connected to the bullet-proof chest plate balance each other, at least in part, since they are directly connected together by the device, thereby reducing the toppling forces to which the user is subjected when using a carrier device on the back that is not secured to the carrying chest plate situated in front of the user's body. Finally, by making use of the shoulder straps of the bullet-proof chest plate, the carrier assembly is inexpensive to make and avoids manufacturing and superposing two pairs of padded load-carrying shoulder straps.

The device of the invention can thus be installed on any military equipment including at least one horizontal attachment strip of sewn flat loops, also known by the term MOLLE.

The harness is made easier to handle for a person acting without help when there is a fifth strap that extends between the first and third straps and/or between the second and fourth straps.

Bullet-proof protection is improved when the bullet-proof chest plate is secured to bullet-proof protection for the back and/or when the harness comprises bullet-proof material.

The back load is easier to secure when the back support is in the shape of a quadrilateral, and fastening points for fastening the back support to the first ends of the first, second, third, and fourth straps are situated in the proximity of the corners of the back support.

The wearing comfort and the ergonomics of the carrier assembly are improved when the back support includes reinforcement made of elastic material.

User safety is improved when the fastener means for fastening a payload to the harness include a quick-release device for releasing the payload quickly.

A reliable quick release device is obtained when the device comprises at least a first strap loop secured to the load or to the harness and a removable blocker extending through the first strap loop.

The harness is fastened reliably to the load when the first strap loop is secured to the load and passes through an opening made in the harness, the blocker including at least one portion bearing against a first face of the harness that is opposite from a second face of the harness and that faces the payload.

The quick release device is compact when the blocker is elongate in shape and/or the carrier assembly includes a sheath for receiving the blocker, at least in part.

The blocker is made easier to insert into the loop when an end of the blocker is curved. Specifically, it is then possible to produce a lever effect with the curved portion.

The tightening of the straps can be adjusted when the first strap and/or the second strap and/or the third strap and/or the fourth strap co-operates with a quick-adjust buckle. The back and front loads are secured to each other and connected to the user by means of the first, second, third, and fourth tightening buckles, which makes it possible to avoid the loads moving in a front plane.

Manufacture is particularly inexpensive when the first quick connector and/or the second quick connector and/or the third quick connector and/or the fourth quick connector is a clip buckle type connector.

The carrier assembly is made more modular when the harness and/or the front equipment includes at least one horizontal attachment strip of sewn flat loops.

A carrier assembly according to any preceding claim, wherein the third quick connector element and/or the fourth quick connector element and/or the fifth quick connector element and/or the sixth quick connector element and/or the seventh quick connector element and/or the eighth quick connector element includes a fastener portion for fastening to a strap loop, which fastener portion is substantially C-shaped.

The comfort and the ergonomics of the assembly are greatly improved when the carrier assembly includes a front pack carrier provided with a tray and two lateral projections arranged to take up the weight of the payload, at least in part, regardless of whether the payload is located on the front, on the sides, or on the back of the wearer's body.

Other characteristics and advantages of the invention appear on reading the following description of a particular, nonlimiting embodiment of the invention.

BRIEF DESCRIPTION OF THE DRAWINGS

Reference is made to the accompanying figures, in which.

DETAILED DESCRIPTION OF THE INVENTION

Figure 1:
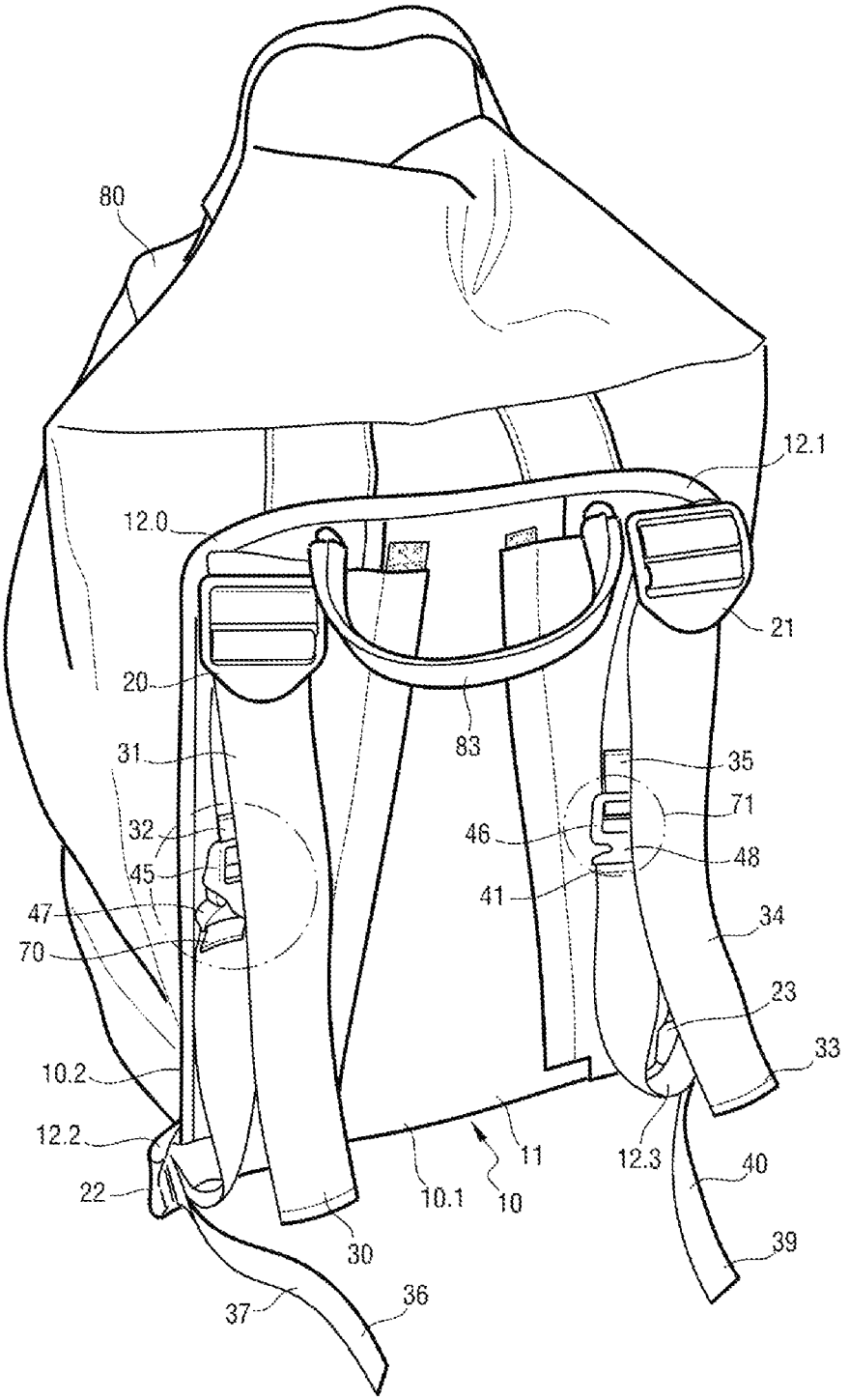
FIG. 1 is a diagrammatic rear view in perspective of a harness of the invention.
Figure 2:
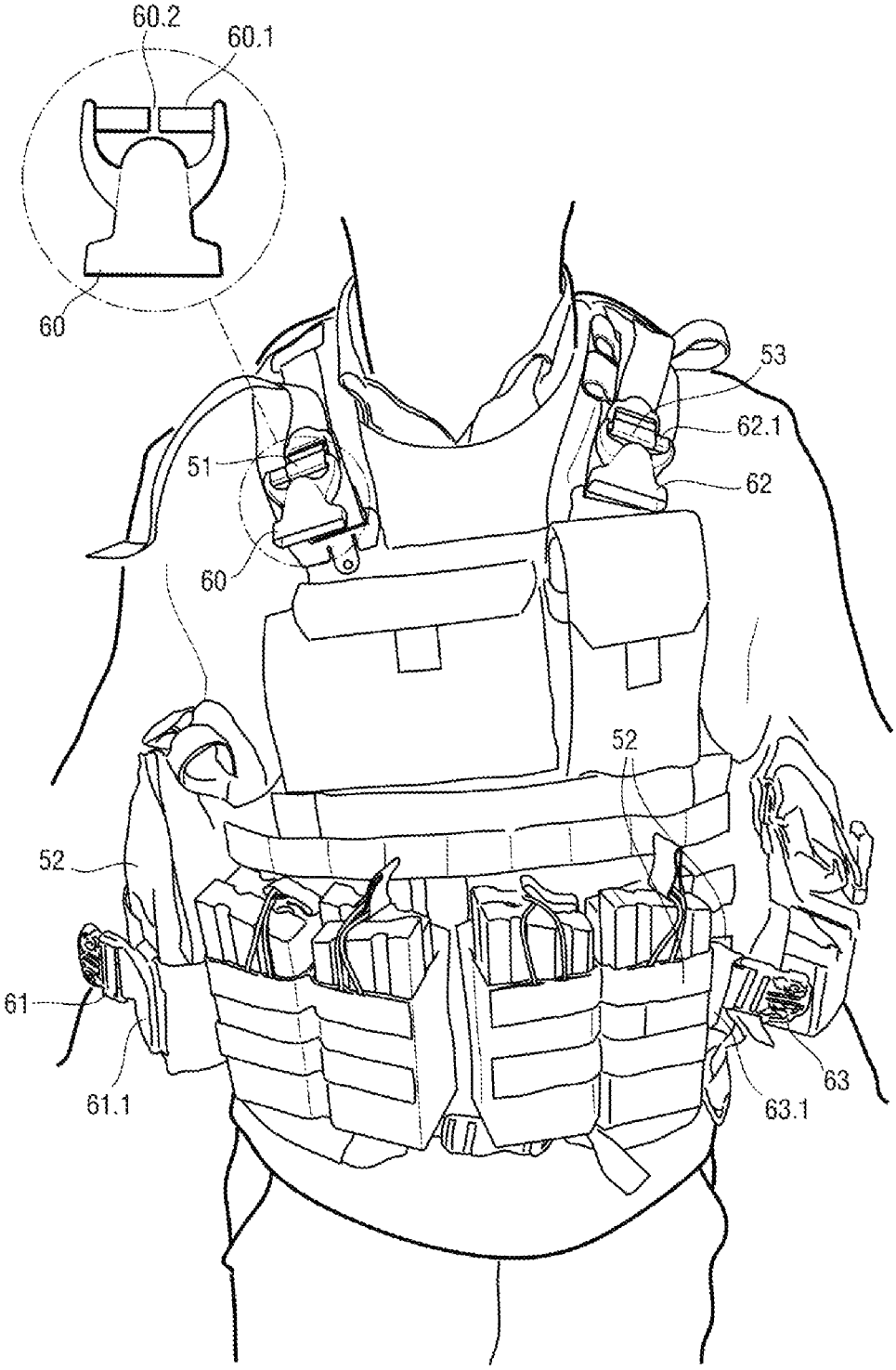
FIG. 2 is a front view in perspective of a user provided with a chest plate of the invention.

With reference to FIGS. 1 and 2, the carrier assembly of the invention, given overall reference 1, comprises a bullet-proof vest 50 and a harness 10 to which a transport pouch 80 is connected.

The harness 10 has a backplate 11 made of polyurethane and substantially in the shape of a quadrilateral. The corners 12.0 to 12.3 of the backplate 11 receive respective first, second, third, and fourth quick-adjust buckles 20, 21, 22, and 22 made of acrylonitrile butadiene styrene (ABS) for the purpose of quickly adjusting strap lengths. A first end 30 of a first strap 31 is engaged in the first buckle 20. The second end 32 of the first strap 31 is provided with a male first element 45 of a first quick connector 70 of clip buckle type.

A first end 33 of a second strap 34 is engaged in the second buckle 21. The second end 35 of the second strap 34 is provided with a male first element 46 of a second quick connector 71.

A first end 36 of a third strap 37 is engaged in the third buckle 22. The second end 38 of the third strap 37 is provided with a female second element 47 of the first quick connector 70.

A first end 39 of a fourth strap 40 is engaged in the fourth buckle 23. The second end 41 of the fourth strap 40 is provided with a female second element 48 of the second quick connector 71.

With reference to FIG. 2, the bullet-proof vest 50 includes a female third quick connector element 60 arranged to cooperate with the male first element 45 of the first quick connector 70. The female third element 60 includes a fastener portion 60.1 for fastening to a strap loop 51 of the bullet-proof vest 50 and presenting a section that is substantially C-shaped. The opening 60.2 in the portion 60.1 allows a strap loop 51 to pass through without needing to be undone.

The bullet-proof vest 50 also has a male fourth quick connector element 61 arranged to cooperate with the female second element 47 of the first quick connector 70. The fourth element 61 is connected to the bullet-proof vest 50 using a first hook-and-loop strip 61.1 passed through flat loops 52 sewn in strips on the bullet-proof vest 50 (MOLLE system).

The bullet-proof vest 50 also has a female fifth quick connector element 62 arranged to cooperate with the male first element 46 of the second quick connector 71. In this example, the female fifth element 62 is identical to the female third element 60 and it includes a fastener portion 62.1 for fastening to a strap loop 53 of the bullet-proof vest 50 and presenting a section that is substantially C-shaped.

Finally, the bullet-proof vest 50 also has a male sixth quick connector element 63 arranged to cooperate with the female second element 48 of the second quick connector 71. In this example, the male sixth element 63 is identical to the male fourth element 61 and is connected to the bullet-proof vest 50 using a second hook-and-loop strip 63.1 passed through flat loops 52 sewn in strips on the bullet-proof vest 50 (MOLLE system).

Figure 3:
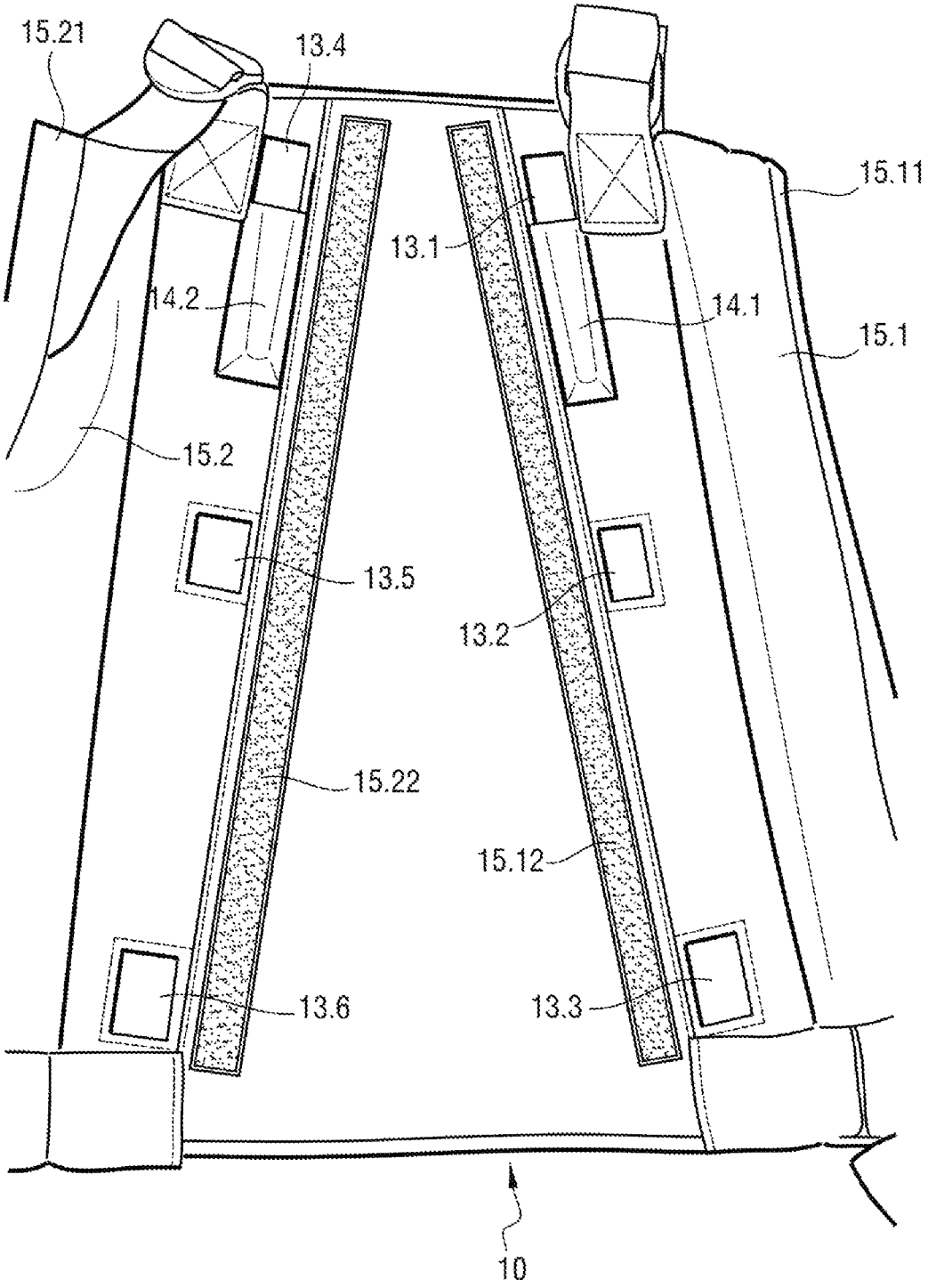
FIG. 3 is a detail view of the harness of FIG. 1.

As can be seen in FIG. 3, the harness 10 has first and second rows of rectangular openings 13.1 to 13.6, each row having three of the openings. The harness 10 also has a first sheath 14.1 and a second sheath 14.2 situated in the proximity respectively of the first opening 13.1 and of the fourth opening 13.4. Finally, the harness 10 has a first flap 15.1 and a second flap 15.2 extending respectively parallel to the first row of openings 13.1 to 13.3 and to the second row of openings 13.3 to 13.6. The first flap 15.1 is provided with a third hook-and-loop strip 15.11 for co-operating with a fourth hook-and-loop strip 15.12 when the first flap 15.1 is folded down so as to lie over the first row of openings 13.1 to 13.3. The second flap 15.2 is provided with a fifth book-and-loop strip 15.21 for co-operating with a sixth book-and-loop strip 15.22 when the second flap 15.2 is folded down and lies over the second row of openings 13.4 to 13.6.

Figure 4:
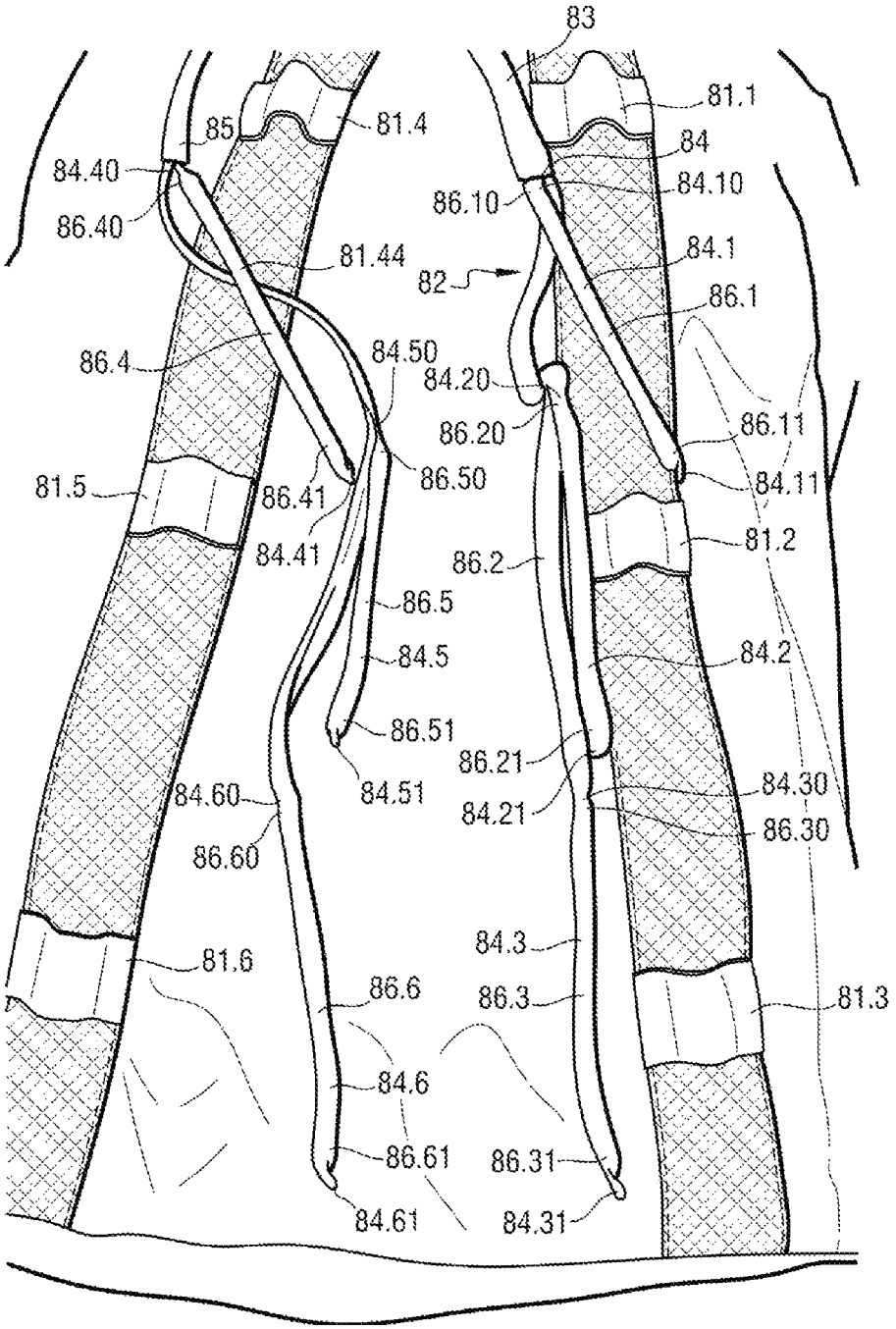
FIG. 4 is a detail view of a payload that is to be connected to the FIG. 1 harness.

As can be seen in FIG. 4, the pouch 80 has two rows of three strap loops 81.1 to 81.6 attached to the pouch 80 by stitching.

The carrier assembly 1 also has a ripcord 82 including a handle 83. A first end 84 of the handle 83 is connected by stitching to a first tubular textile sleeve 84.1, to a second tubular textile sleeve 84.2, and to a third tubular textile sleeve 84.3. A second end 85 of the handle 83 is connected by stitching to a fourth tubular textile sleeve 84.4, to a fifth tubular textile sleeve 84.5, and to a sixth tubular textile sleeve 84.6.

The first sleeve 84.1 encloses a first cylindrical rod 86.1 that is blocked at its top end 86.10 by means of first top stitching 84.10 and at its bottom end 86.11 by means of first bottom stitching 84.11.

The second sleeve 84.2 encloses a second cylindrical rod 86.2 that is blocked at its top end 86.20 by means of second top stitching 84.20 and at its bottom end 86.21 by means of second bottom stitching 84.21.

The third sleeve 84.3 encloses a third cylindrical rod 86.3 that is blocked at its top end 86.30 by means of third top stitching 84.30 and at its bottom end 86.31 by means of third bottom stitching 84.31.

The fourth sleeve 84.4 encloses a fourth cylindrical rod 86.4 that is blocked at its top end 86.40 by means of fourth top stitching 84.40 and at its bottom end 86.41 by means of fourth bottom stitching 84.41.

The fifth sleeve 84.5 encloses a fifth cylindrical rod 86.5 that is blocked at its top end 86.50 by means of fifth top stitching 84.50 and at its bottom end 86.51 by means of fifth bottom stitching 84.51.

Finally, the sixth sleeve 84.6 encloses a sixth cylindrical rod 86.6 that is blocked at its top end 86.60 by means of sixth top stitching 84.60 and at its bottom end 86.61 by means of sixth bottom stitching 84.61.

As can be seen in FIG. 4, the respective bottom ends 86.11, 86.21, 86.31, 86.41, 86.51, and 86.61 of the first rod 86.1, of the second rod 86.2, of the third rod 86.3, of the fourth rod 86.4, of the fifth rod 86.5, and of the sixth rod 86.6 are all curved.

The loops 81.1 to 81.6, the openings 13.1 to 13.6, and the ripcord 82 constitute a rapid release device for releasing the pouch 80.

Figure 5:
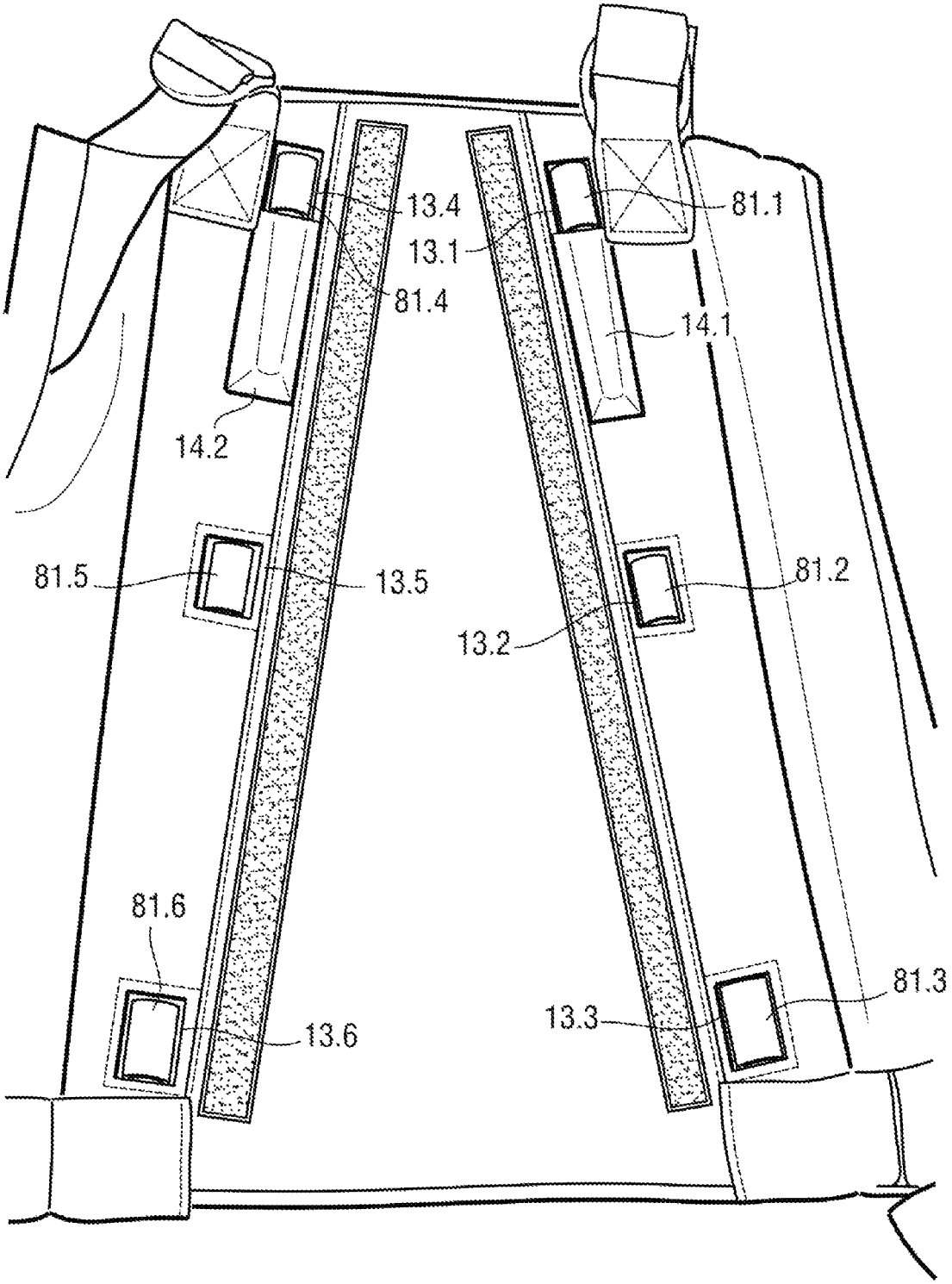
FIG. 5 is a detail view of a payload shown on the FIG. 1 harness.
Figure 6:
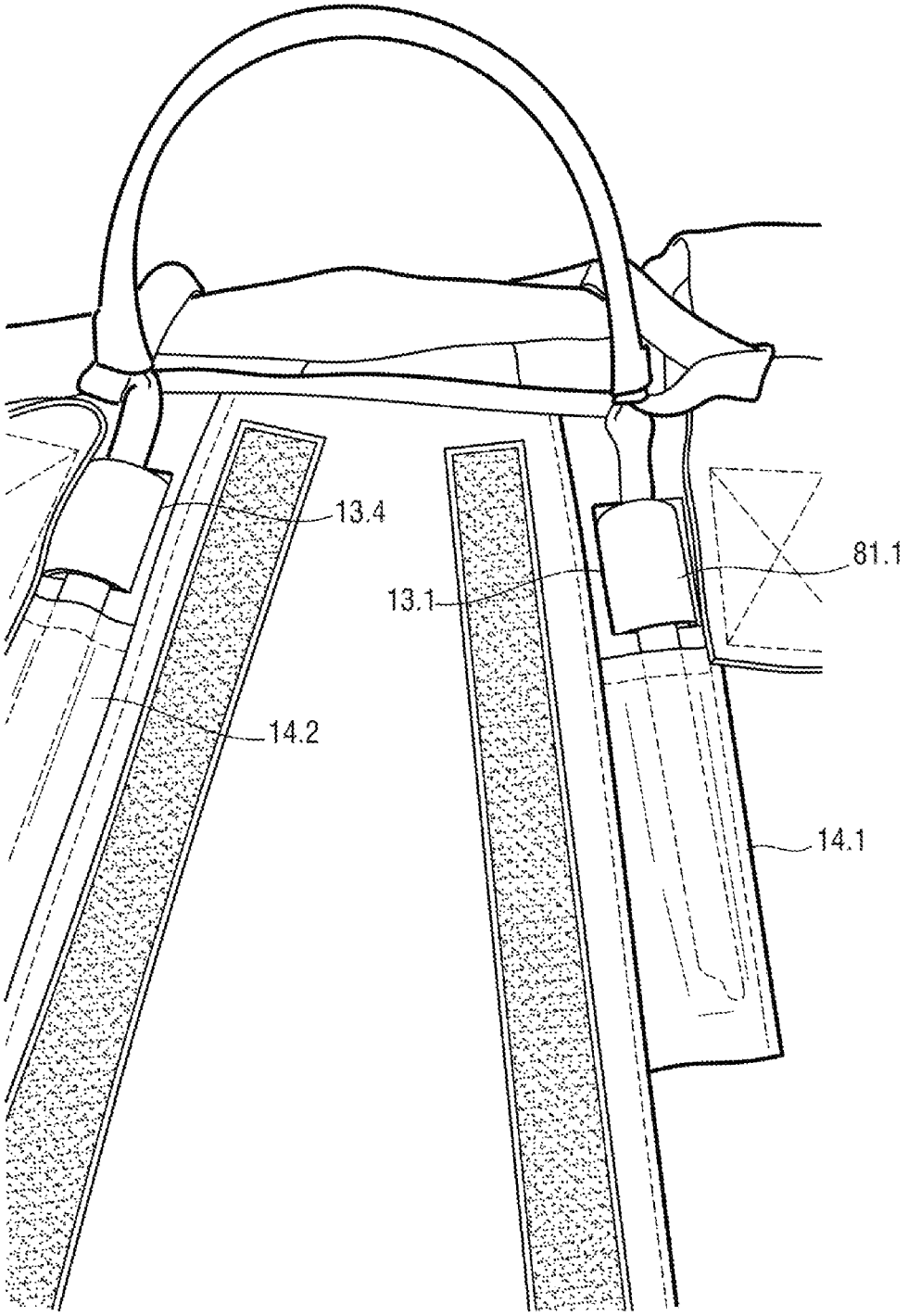
FIG. 6 is a first detail view of a quick-release device for the payload of the invention.
Figure 7:
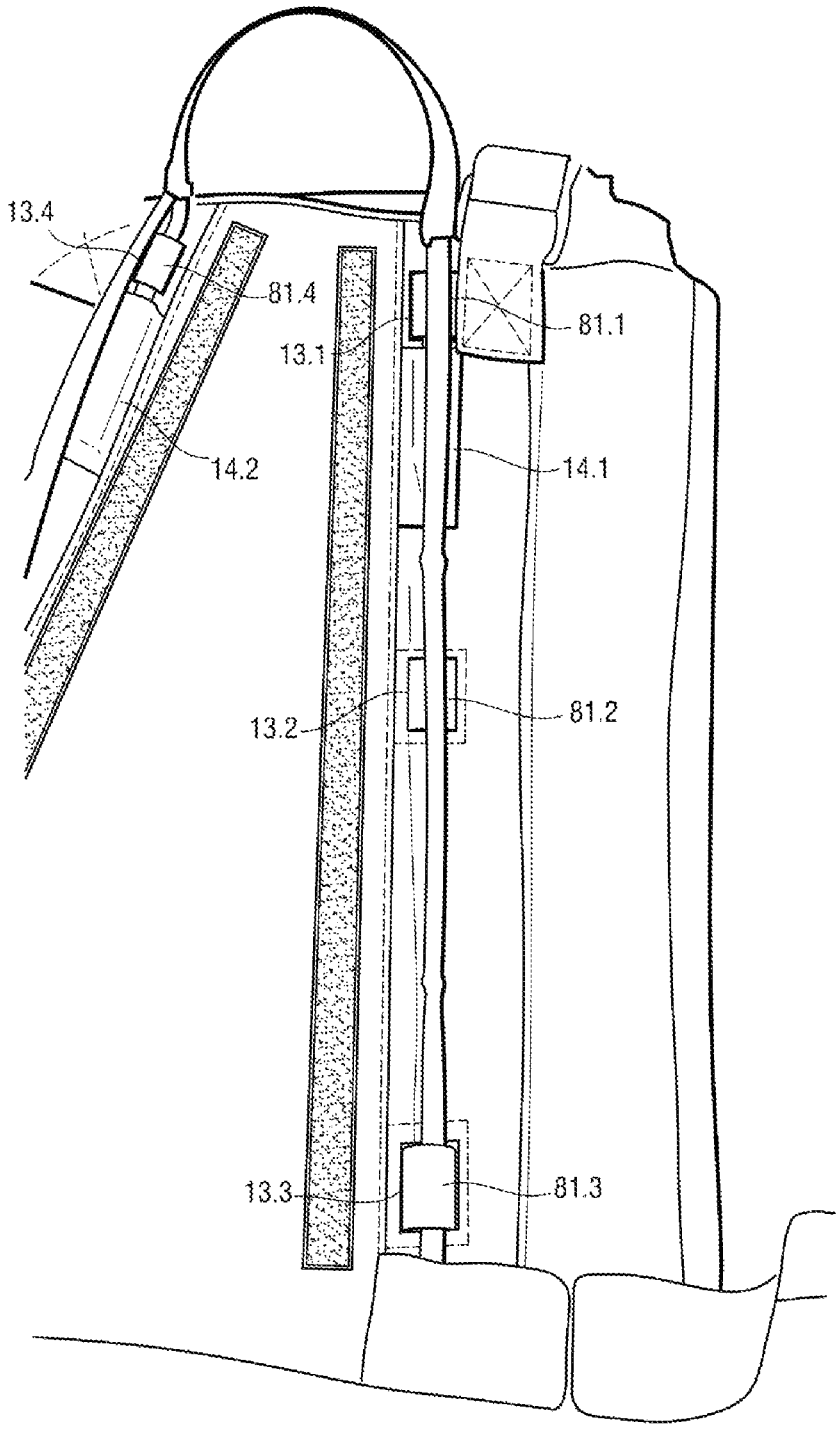
FIG. 7 is a second detail view of a payload that is to be connected to the FIG. 1 harness.

As can be seen in FIG. 5, the harness 10 and the pouch 80 are presented in such a manner that the loops 81.1 to 81.6 pass through the openings 13.1 to 13.4. The first rod 86.1 is then engaged in the first loop 81.1 to extend through the first loop 81.1 in such a manner that the first sheath 14.1 receives the end 86.11 of the first rod 86.1 (FIG. 6). The fourth rod 86.4 is then engaged in the fourth loop 81.4 to extend through the fourth loop 81.4 in such a manner that the second sheath 14.2 receives the end 86.41 of the fourth rod 86.4 (FIG. 6). The second rod 86.2, the third rod 86.3, the fifth rod 86.5, and the sixth rod 86.6 are then engaged in similar manner so as to extend respectively through the second loop 81.2, the third loop 81.3, the fifth loop 81.5, and the sixth loop 81.6.

Thus, each rod 86.1 to 86.6 has two portions bearing against a first face 10.1 of the harness 10 that is opposite from a second face 10.2 of the harness 10 and that faces the pouch 80.

Figure 8:
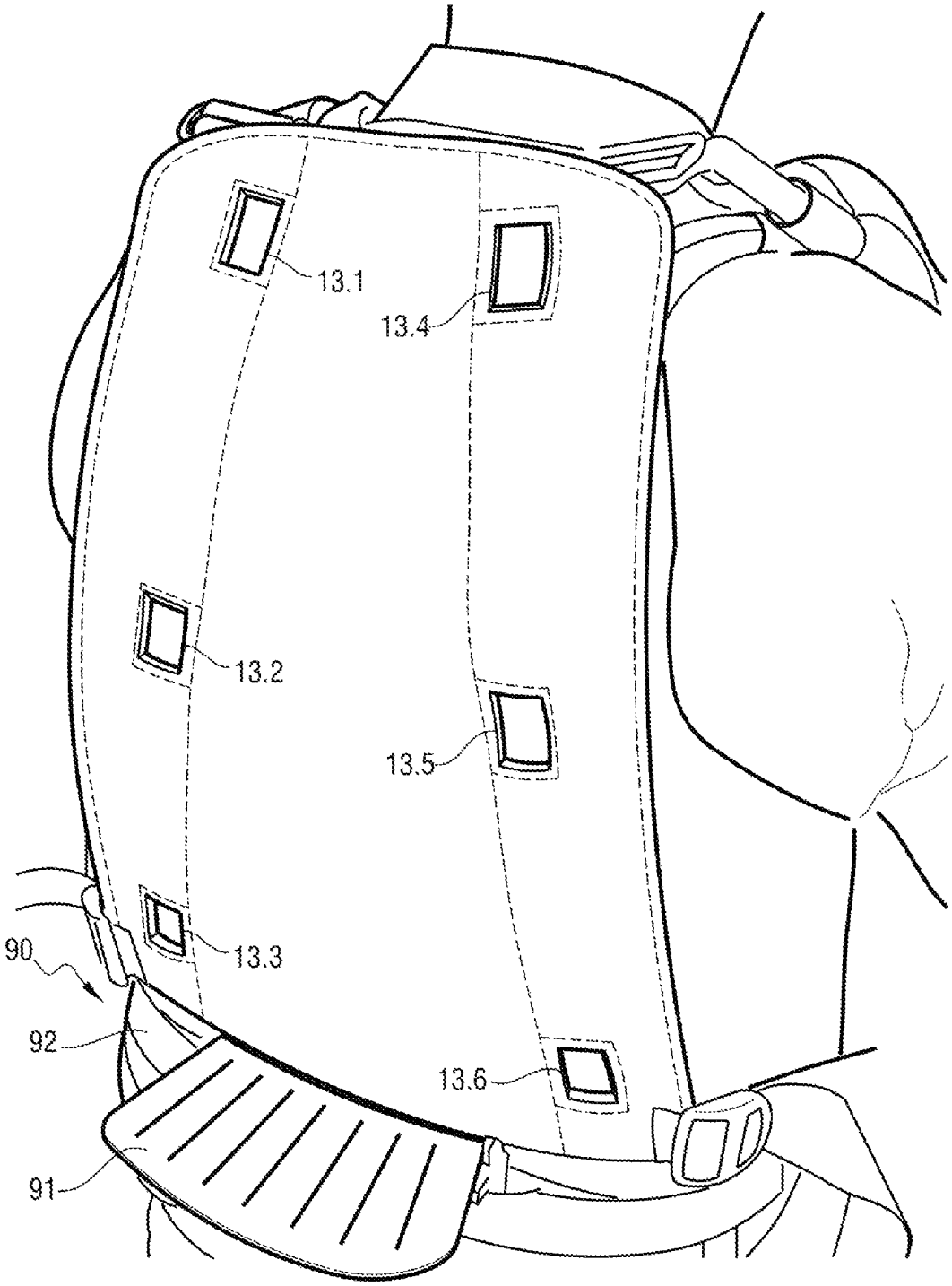
FIG. 8 is detail view of the harness of the invention provided with a pack carrier.
Figure 9:
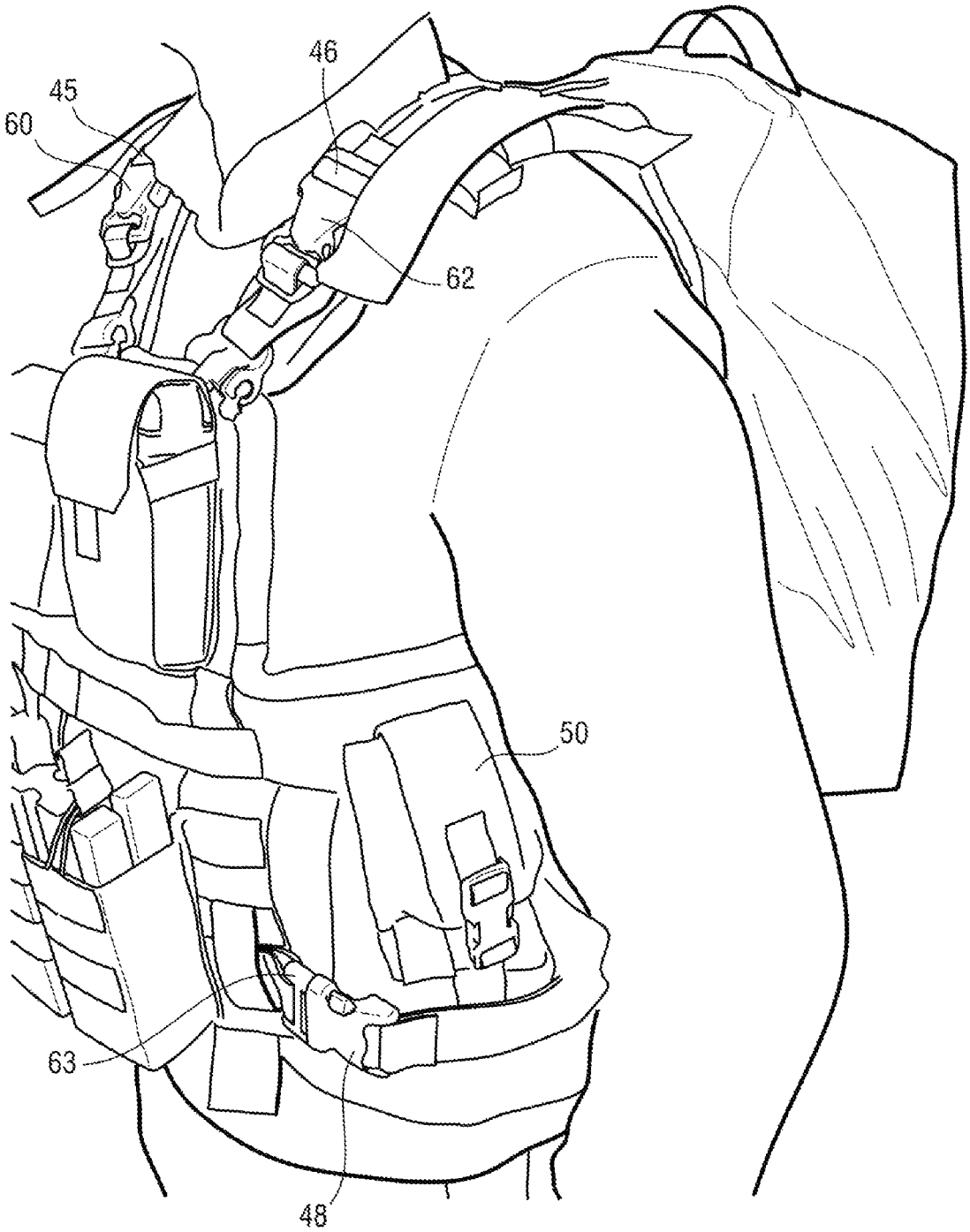
FIG. 9 is a detail view of the carrier assembly of the invention.

Preferably, but not necessarily, the carrier assembly 1 includes a pack carrier 90 provided with a tray 91 projecting from a belt 92 and arranged to take up at least part of the weight of the pouch 80 (FIG. 8).

Use of the carrier assembly 1 is described below. In a first step, the user connects together the first strap 31 and the third strap 37 using the first quick connector 70. The user also connects together the second strap 34 and the fourth strap 40 using the second quick connector 71. The user, who is already wearing the bullet-proof vest 50, places the resulting shoulder straps on the shoulders and causes the pouch 80 to rest on the tray 91. The user then separates the male first element 45 from the female second element 47 of the first quick connector 70 and connects the male first element 45 of the first quick connector 70 to the female third quick connector element 60 of the bullet-proof vest 50. The user then connects the female second element 47 of the first quick connector 70 to the male fourth quick connector element 61 of the bullet-proof vest 50. In corresponding manner, the user separates the male first element 46 from the female second element 48 of the second quick connector 71 and connects the male first element 46 of the second quick connector 71 to the female fifth quick connector element 62 of the bullet-proof vest 50. The user then connects the female second element 48 of the second quick connector 71 to the male sixth quick connector element 63 of the bullet-proof vest 50. By acting on the first ends 30, 33, 36, and 39 respectively of the first strap 31, of the second strap 34, of the third strap 37, and of the fourth strap 40, the user adjusts the lengths of the first strap 31, of the second strap 34, of the third strap 37, and of the fourth strap 40 so as to put them under tension.

Thus, now that it is attached to the bullet-proof vest 50, the weight of the pouch 80 is balanced at least in part by the equipment attached to the front portion of the bullet-proof vest 50. The pressure that would normally be exerted on the user's torso by a prior art backpack is reduced. Finally, the tray 91 serves to reduce the vertical loading applied to the user's shoulders and enables some weight to be taken up by the user's pelvis. Thus, the user can don the backpack without help and can integrate the bullet-proof vest 50 with the attachment of the backpack without that resulting in interactions that are uncomfortable for the user. By making use of the shoulder straps of the bullet-proof vest 50, the carrier assembly 1 is inexpensive to make and avoids superposing two pairs of padded load-carrying shoulder straps.

In an emergency, by pulling on the handle 83, the user can extract the rods 86.1 to 86.6 from the loops 81.1 to 81.6 and separate the pouch 80 from the harness 10.

Figure 10:
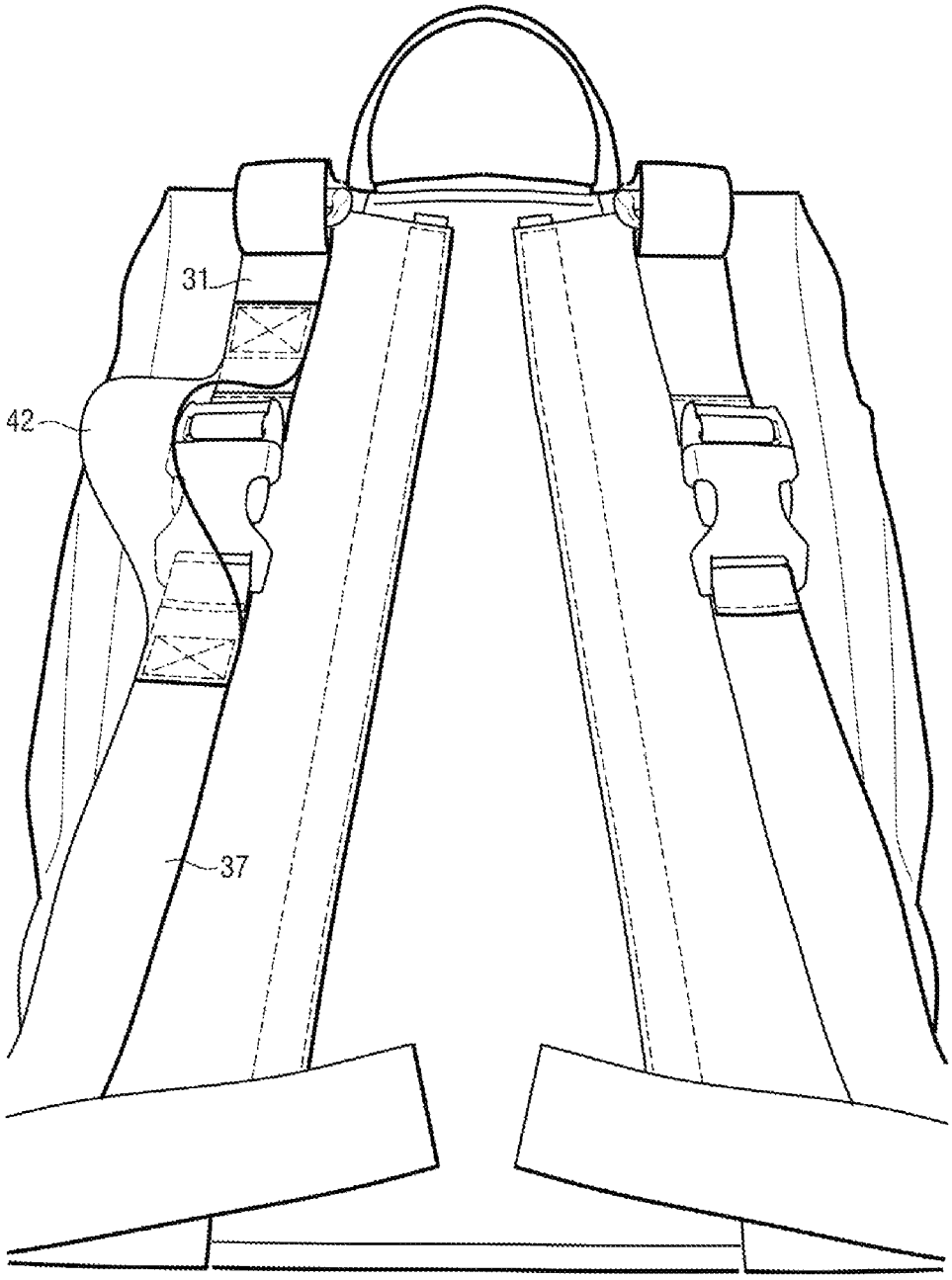
FIG. 10 is a detail view of the harness in a second embodiment of the invention.

In a second embodiment shown in FIG. 10, the harness 10 has a fifth strap 42 extending between the first strap 31 and the third strap 37. In this example, the fifth strap 42 is sewn onto the first strap 31 and the third strap 37, and it extends parallel to the first strap 31 and the third strap 37. Thus, when separating the harness 10 from the bullet-proof vest 50, the user retains a point for carrying the harness 10.

Naturally, the invention is not limited to the embodiment described, but covers any variant coming within the ambit of the invention as defined by the claims.

In particular:

- although, above, the carrier assembly has a carrying pouch, invention also applies to other types of payload, e.g. such as a rocket launcher, telecommunications equipment, or a water tank;
- although, above, the harness includes a polyurethane backplate, the invention also applies to other types of elastic reinforcement incorporated in the back support, e.g. such as a plurality of blades made of metal or carbon. The invention also applies to a textile back support that does not include any reinforcement or in which the backplate and/or the textile support of the harness comprises bullet-proof material;
- although, above, the backplate is in the shape of a quadrilateral, the invention also applies to shapes of other types, e.g. such as a shape that is circular, triangular, or arbitrary;
- although, above, the straps are connected to a back support by adjustable straps, the invention also applies to other means for connecting the straps to the back support, e.g. such as a connection that is glued, sewn, riveted, or made using a carabiner;
- although, above, the carrier assembly includes quick-adjust buckles made of ABS, the invention also applies to other types of quick adjustment buckles, e.g. such as a metal frame with a sliding or stationary bar, an assembly of two rectangular buckles or eyelets, a lever system;

although, above, the quick connectors are of the clip buckle type comprising a male portion and a female portion, the invention also applies to other types of quick connector, e.g. such as assembly by means of carabiners having no distinction between male and female;

although, above, the bullet-proof vest comprises a front bullet-proof chest plate and back bullet-proof protection, the invention also applies to a front bullet-proof chest plate on its own;

although, above, the assembly has hook-and-loop strips, the invention also applies to other reversible connection means, e.g. such as a magnetic strip, press studs, a zip fastener;

although, above, the harness includes openings and the payload has strap loops, the invention also applies to a harness having strap loops and a payload including openings;

although, above, the harness has six openings in two rows and the payload has six strap loops in two rows, the invention also applies to a harness having some other number of strap loops and to a payload having some other number of openings, e.g. such as a single opening/loop set, or more than six opening/loop sets, which sets may be distributed in more than two rows, in a single row, or in arbitrary manner;

although, above, the quick-release device comprises cylindrical pins, the invention also applies to other types of elongate blocker, e.g. rods that are solid or tubular, of section that may be square, rectangular, or arbitrary. The blocker may equally well be disk-shaped or of arbitrary shape;

although, above, the fifth strap is sewn between the first and third straps, the invention also applies to a fifth strap extending between the second and fourth straps. The fifth strap could also be mounted slidably on one and/or the other of the straps;

although, above, the fifth strap extends parallel to the first and third straps, the invention also applies to other orientations for the fifth strap relative to the first and third straps, e.g. such as an orientation that is orthogonal to one and/or the other of the straps, or an arbitrary orientation.

The invention claimed is:

1. A carrier assembly comprising a harness and a front bullet-proof chest plate;

the harness comprising:

a back support;

fastener means for fastening a payload to the harness;

a first strap having a first end connected to the back support, and a second end provided with a first element of a first quick connector;

a second strap having a first end connected to the back support, and a second end provided with a first element of a second quick connector;

a third strap having a first end connected to the back support, and a second end provided with a second element of the first quick connector; and a fourth strap having a first end connected to the back support, and a second end provided with a second element of the second quick connector;

the front bullet-proof chest plate comprising:

a third quick connector element arranged to cooperate with the first element of the first quick connector;

a fourth quick connector element arranged to cooperate with the second element of the first quick connector;

a fifth quick connector element arranged to cooperate with the first element of the second quick connector; and a sixth quick connector element arranged to cooperate with the second element of the second quick connector;

the carrier assembly including a fifth strap extending between the first strap and the third strap and/or between the second strap and the fourth strap.

2. The carrier assembly according claim 1, wherein the bullet-proof chest plate is secured to bullet-proof protection for the back.

3. The carrier assembly according to claim 1, wherein the back support is in the shape of a quadrilateral, and fastening points for fastening the back support to the first ends of the first, second, third, and fourth straps are situated in the proximity of the corners of the back support.

4. The carrier assembly according to claim 1, wherein the back support includes reinforcement made of elastic material.

5. The carrier assembly according to claim 1, wherein the harness comprises bullet-proof material.

6. The carrier assembly according to claim 1, wherein the fastener means for fastening a payload to the harness include a quick-release device for releasing the payload quickly.

7. The carrier assembly according to claim 6, wherein the quick-release device comprises at least a first strap loop secured to the load or to the harness and a removable blocker passing through the first strap loop.

8. The carrier assembly according to claim 6, wherein the first strap loop is secured to the payload and passes through an opening made in the harness, the blocker including at least one portion bearing against a first face of the harness that is opposite from a second face of the harness and that faces the payload.

9. The carrier assembly according to claim 7, wherein the blocker is elongate in shape.

10. The carrier assembly according to claim 9, wherein one end of the blocker is curved.

11. The carrier assembly according to claim 7, including a sheath for receiving the blocker, at least in part.

12. The carrier assembly according to claim 1, wherein the first strap and/or the second strap and/or the third strap and/or the fourth strap co-operates with a quick-adjust buckle.

13. The carrier assembly according to claim 1, wherein the first quick connector and/or the second quick connector and/or the third quick connector and/or the fourth quick connector is a clip buckle type connector.

14. The carrier assembly according to claim 1, wherein the harness and/or the front bullet-proof chest plate includes at least one horizontal attachment strip of sewn flat loops.

15. The carrier assembly according to claim 1, wherein the third quick connector element and/or the fourth quick connector element and/or the fifth quick connector element and/or the sixth quick connector element and/or a seventh quick connector element and/or an eighth quick connector element includes a fastener portion for fastening to a strap loop, which fastener portion is substantially C-shaped.

16. The carrier assembly according to claim 1, including a pack carrier provided with a tray and two lateral projections arranged to take up the weight of the payload, at least in part, regardless of whether the payload is located on the front, on the sides, or on the back of the wearer's body.

* * * * *